US007695341B1

(12) United States Patent
Maddocks et al.

(10) Patent No.: US 7,695,341 B1
(45) Date of Patent: Apr. 13, 2010

(54) ELECTROMECHANICAL TOY

(75) Inventors: Richard J Maddocks, Barrington, RI (US); Leif J. Askeland, Cranston, RI (US); Michael J. Iaconis, Wrentham, MA (US); Adam B. Craft, Mansfield, MA (US); Robert P. Felice, Woonsocket, RI (US)

(73) Assignee: Hasbro, Inc., Pawtucket, RI (US)

( * ) Notice: Subject to any disclaimer, the term of this patent is extended or adjusted under 35 U.S.C. 154(b) by 409 days.

(21) Appl. No.: 10/305,265

(22) Filed: Nov. 27, 2002

(51) Int. Cl.
*A63H 3/20* (2006.01)

(52) U.S. Cl. ..... 446/330; 446/338; 446/353

(58) Field of Classification Search ..... 446/175, 446/298, 300, 330, 338, 353, 358, 384; 472/95, 472/96, 97; 49/32, 140, 263, 264
See application file for complete search history.

(56) References Cited

U.S. PATENT DOCUMENTS

| | | | | |
|---|---|---|---|---|
| 112,550 | A | | 3/1871 | Clay |
| 1,345,052 | A | | 6/1920 | Williams |
| 1,574,035 | A | | 2/1926 | Holtzman |
| 1,601,983 | A | | 10/1926 | Savage |
| 1,639,442 | A | | 8/1927 | Strauss et al. |
| 1,782,477 | A | | 11/1930 | Price |
| 1,891,816 | A | | 12/1932 | Hewitt |
| 1,992,477 | A | | 2/1935 | Domowitch et al. |
| 2,158,860 | A | | 5/1939 | Hyde |
| 2,194,537 | A | | 3/1940 | Adams |
| 2,232,615 | A | | 2/1941 | Kupka |
| 2,421,279 | A | | 5/1947 | Marty |
| 2,596,216 | A | | 5/1952 | Dawson |
| 2,606,022 | A | * | 8/1952 | Vander Veer et al. ..... 91/417 R |
| 2,614,365 | A | | 10/1952 | Musselwhite et al. |
| 2,620,594 | A | | 12/1952 | Parisi |
| 2,641,865 | A | | 6/1953 | Gowland |
| 2,738,617 | A | | 3/1956 | Capehart |
| 2,782,032 | A | * | 2/1957 | Plympton ..... 472/97 |
| 2,800,323 | A | * | 7/1957 | West et al. ..... 49/32 |
| 2,801,104 | A | * | 7/1957 | Yetter ..... 472/97 |
| 2,910,799 | A | | 11/1959 | Wentworth |
| 3,153,871 | A | | 10/1964 | Semba |
| 3,163,960 | A | | 1/1965 | Iwaya et al. |
| 3,164,924 | A | | 1/1965 | Iwaya et al. |
| 3,181,270 | A | | 5/1965 | Trevena |
| 3,199,248 | A | | 8/1965 | Suzuki |

(Continued)

FOREIGN PATENT DOCUMENTS

DE 19755465 A1 3/1940

(Continued)

OTHER PUBLICATIONS

U.S. Appl. No. 10/667,977, filed Sep. 23, 2003.

(Continued)

*Primary Examiner*—John Ricci
(74) *Attorney, Agent, or Firm*—DiBerardino Law LLC

(57) ABSTRACT

A toy includes a sensor that senses a condition, a movable region, and an actuator coupled to the movable region to move the movable region in a direction relative to the sensed condition. The movable region is coupled to a body that houses electromechanical components for sensing conditions and for moving the movable region in response to the detected conditions.

45 Claims, 19 Drawing Sheets

U.S. PATENT DOCUMENTS 3,266,059 A 8/1966 Stelle
3,395,483 A 8/1968 Mullins
3,443,338 A 5/1969 Collins
3,484,988 A 12/1969 Robbins
3,490,172 A 1/1970 Schwartz
3,568,363 A 3/1971 Tanimura
3,705,387 A 12/1972 Stern et al.
3,940,879 A 3/1976 Glass et al.
3,981,098 A 9/1976 Darda
4,086,724 A 5/1978 McCaslin
4,109,913 A 8/1978 Nielsen
4,125,261 A 11/1978 Lahr
4,143,484 A 3/1979 Yonezawa
4,155,197 A 5/1979 Beny et al.
4,165,581 A 8/1979 Wolf
4,224,759 A 9/1980 Saint-Pierre et al.
4,231,183 A 11/1980 Lahr
4,245,515 A 1/1981 Iwaya
4,248,012 A 2/1981 Kirby et al.
4,276,717 A 7/1981 Zbriger et al.
4,333,261 A 6/1982 Jones et al.
4,363,187 A 12/1982 Shinohara
4,389,811 A 6/1983 Iwaya et al.
4,453,712 A 6/1984 Lee
4,479,327 A 10/1984 Wakimura
4,494,417 A 1/1985 Larson et al.
4,516,951 A 5/1985 Saigo et al.
4,540,176 A 9/1985 Baer
4,571,208 A 2/1986 Saigo et al.
4,573,941 A 3/1986 Holden et al.
4,595,381 A 6/1986 Dibold et al.
4,601,671 A 7/1986 DeMars
4,636,177 A 1/1987 Koguchi
4,655,724 A 4/1987 Law
4,662,854 A 5/1987 Fang
4,671,779 A 6/1987 Kurosawa
4,673,371 A 6/1987 Furukawa
4,680,022 A 7/1987 Hoshino et al.
4,708,688 A 11/1987 Lee
4,717,364 A 1/1988 Furukawa
4,775,351 A 10/1988 Provenzano, Jr.
4,795,395 A 1/1989 Oishi et al.
4,798,553 A 1/1989 Gentles et al.
4,802,878 A 2/1989 Terzian et al.
4,810,226 A 3/1989 Takahashi et al.
4,815,911 A 3/1989 Bengtsson et al.
4,820,232 A 4/1989 Takahashi et al.
4,822,285 A 4/1989 Summerville
4,828,525 A 5/1989 Okano
4,846,756 A 7/1989 Hesse
4,878,875 A 11/1989 Pin-Hung et al.
4,909,770 A 3/1990 Hesse
4,913,676 A 4/1990 Koguchi et al.
4,923,428 A 5/1990 Curran
4,944,708 A 7/1990 Kawabe
4,968,280 A 11/1990 Kelley
5,011,449 A 4/1991 Handy et al.
5,030,160 A 7/1991 Klawitter
5,056,249 A 10/1991 Sakurai
5,080,681 A 1/1992 Erb
5,080,682 A 1/1992 Schectman
5,094,645 A 3/1992 Stern et al.
5,141,464 A * 8/1992 Stern et al. ..... 446/338
5,158,492 A * 10/1992 Rudell et al. ..... 446/175
5,195,920 A 3/1993 Collier
5,267,886 A 12/1993 Wood et al.
5,295,893 A 3/1994 Chiu
5,297,443 A 3/1994 Wentz
5,306,199 A 4/1994 Locricchio
5,316,516 A 5/1994 Saitoh
5,324,225 A 6/1994 Satoh et al.
5,374,216 A 12/1994 Jung et al.
5,409,447 A 4/1995 Wedge, Jr.
5,505,493 A 4/1996 Camfield et al.
5,876,263 A 3/1999 DeCesare et al.
5,908,345 A 6/1999 Choi
5,941,755 A 8/1999 Danielian
6,053,797 A * 4/2000 Tsang et al. ..... 446/297
6,059,666 A * 5/2000 Ohara et al. ..... 472/97
6,083,104 A 7/2000 Choi
6,089,948 A * 7/2000 LaBarbara et al. ..... 446/318
6,139,394 A 10/2000 Maxim
6,142,851 A 11/2000 Lewinski et al.
6,160,986 A 12/2000 Gabai et al.
6,210,167 B1 * 4/2001 Nishiyama ..... 434/247
6,250,987 B1 6/2001 Choi
6,273,782 B1 8/2001 Chan et al.
6,350,170 B1 2/2002 Liu
6,371,826 B1 * 4/2002 Pestonji ..... 446/337
6,386,943 B1 5/2002 Chang
6,435,936 B1 8/2002 Rehkemper et al.
6,458,010 B1 10/2002 Yamahishi et al.
6,461,218 B1 10/2002 Mullaney et al.
6,471,565 B2 * 10/2002 Simeray ..... 446/298
6,514,117 B1 2/2003 Hampton et al.
6,546,663 B1 4/2003 Signitzer et al.
6,554,679 B1 * 4/2003 Shackelford et al. ..... 446/268
6,565,407 B1 * 5/2003 Woolington et al. ..... 446/175
6,602,106 B2 8/2003 Cheung
6,652,353 B1 * 11/2003 Lund et al. ..... 446/356
6,661,239 B1 12/2003 Ozick
6,666,744 B2 * 12/2003 Llorens ..... 446/268
6,672,934 B2 1/2004 Hornsby et al.
6,695,672 B1 * 2/2004 Rehkemper et al. ..... 446/298
6,695,673 B1 2/2004 Stadbauer
6,699,098 B1 3/2004 Kau
6,769,954 B2 8/2004 Su
6,807,766 B1 10/2004 Hughes et al.
6,940,291 B1 9/2005 Ozick
7,025,657 B2 * 4/2006 Nishimoto ..... 446/484
2001/0029147 A1 10/2001 Hornsby et al.
2004/0152394 A1 * 8/2004 Marine et al. ..... 446/175

FOREIGN PATENT DOCUMENTS

EP 641580 A1 3/1995
GB 2222959 A 5/1947
GB 2221401 A 8/1966
JP 11-207042 8/1999
JP 2001-300149 10/2001

OTHER PUBLICATIONS

U.S. Appl. No. 10/425,992, filed Apr. 30, 2003.
U.S. Appl. No. 10/698,930, filed Nov. 3, 2003.
The WowWee horse, a toy horse produced by WowWee in 2002 and shown at Toy Fair in Feb. 2003 in NY, NY, 3 pages of photographs.
The Hasbro dog, a toy dog produced and sold by Hasbro in the U.S. before the year 2000, 3 pages of photographs.
USPTO Office Action mailed Mar. 8, 2007 for U.S. Appl. No. 10/837,570 (7 pages).
USPTO Office Action mailed Aug. 22, 2007 for U.S. Appl. No. 10/837,570 (8 pages).
Office Action mailed on Dec. 27, 2007 in related U.S. Appl. No. 10/837,570, 6 pages.

* cited by examiner

ELECTROMECHANICAL TOY

TECHNICAL FIELD

This description relates to an electromechanical toy.

BACKGROUND

Toys that have moving parts are well known. For example, dolls and plush toys such as stuffed animals are made with moveable appendages.

SUMMARY

In one general aspect, a toy includes a sensor that senses a condition, a movable region, and an actuator coupled to the movable region to move the movable region in a direction relative to the sensed condition.

Implementations may include one or more of the following features. For example, the tail region may include a flexible strip, a plate positioned in a portion of the tail region and being transversely connected to the flexible strip, and an elongated device that intersects the plate.

The actuator may include a motor that drives the tail region, and a coupling device that couples the body, the back region, and the tail region. The coupling device may include a body-to-back piece and a back-to-tail piece coupled to the body-to-back piece at a back pivot within the back region. The body-to-back piece may include a first end that pivots about a body pivot within the body, and a second end that pivots about the back pivot. The back-to-tail piece includes a first end that pivots about the back pivot, and a second end that pivots about a tail pivot within the tail region. The back pivot may move toward the back region and cause the flexible portion of the back region to arch when the tail region is raised.

The flexible portion may include a center elongated portion that extends along an elongated axis, and ribs extending from the center elongated portion to facilitate bending of the flexible portion.

The back region and the tail region may each include a sensor that is coupled to the actuator.

In another general aspect, a toy is actuated by sensing a condition within a tail region coupled to a body of the toy, raising the tail region in response to the sensed condition, and arching a back region coupled to the body simultaneously with raising the tail region.

Implementations may include one or more of the following features. For example, sensing the condition within the tail region may include sensing a change in capacitance, inductance, pressure, light intensity, and/or audio intensity at the tail region.

Raising the tail region in response to the sensed condition may include actuating a motor couped to the tail region to raise the tail region. Arching the back region simultaneously with raising the tail region may include pivoting a first end of a body-to-back piece about a body pivot within the body, and pivoting a second end of the body-to-back piece about a back pivot within the back region. Arching the back region simultaneously with raising the tail region may include coupling a back-to-tail piece to the body-to-back piece at the back pivot, pivoting a first end of the back-to-tail piece about the back pivot, and pivoting a second end of the back-to-tail piece about a tail pivot within the tail region. Raising the tail region may include moving the back pivot toward the back region and causing the flexible portion of the back region to arch.

In another general aspect, an apparatus for actuating a toy includes a motor within a body of the toy and coupled to a tail region, and a device. The device is fixed to the body at a body end, fixed to the tail region at a tail end, and coupled to a movable portion of a back region between the body end and the tail end. The device is positioned relative to the body, tail region, and back region such that, as the motor raises the tail region, the device moves and rotates about the body end and causes the movable portion of the back region to arch.

In a further general aspect, a toy includes a sensor that senses a condition, a movable region, and an actuator coupled to the movable region to move the movable region in a direction relative to the sensed condition.

Implementations may include one or more of the following features. For example, the sensor may include a touch-sensitive device, such as a capacitively-coupled device or a inductively-coupled device. The sensor also may include a pressure-activated switch, a light-sensing device, or a sound-sensing device.

The actuator may move the movable region in a direction towards or away from the sensed condition.

In a further general aspect, a toy is actuated by receiving a sensed condition at a portion of the toy, and moving the portion of the toy relative to a body of the toy in a direction relative to the sensed condition.

Implementations may include one or more of the following features. For example, moving the toy portion may include moving the toy portion towards or away from the sensed condition. Receiving the sensed condition may include receiving a change in capacitance, inductance, pressure, light intensity and/or audio intensity at the toy portion.

The method may also include outputting an audio signal in response to the received condition. The outputting of the audio signal may be performed simultaneously with moving the toy portion.

In another general aspect, a toy includes a body, a tail region coupled to the body, a head region coupled to the body, and an apparatus within the body that locks the tail region when moving the head region and locks the head region when moving the tail region.

In a further aspect, an apparatus for actuating a toy includes a drive wheel including a drive pin, a first device, a second device, and a motor coupled to the drive wheel to rotate the drive wheel in opposite directions. The first device includes a first slot sized to fit the drive pin, a first concave surface sized to match a convex portion of the drive wheel, and a first mechanism coupled to a head region of the toy. The second device includes a second slot sized to fit the drive pin, a second concave surface sized to match the convex portion of the drive wheel, and a second mechanism coupled to a tail region of the toy. The first device, the second device, and the drive wheel are positioned relative to each other such that, if the drive pin engages the first slot, then the convex portion of the drive wheel disengages the first concave surface and engages the second concave surface, and if the drive pin engages the second slot, then the convex portion of the drive wheel disengages the second concave surface and engages the first concave surface.

Aspects of the toy can include one or more of the following advantages. For example, all motions of the toy may be controlled by a single motor through the use of a double gear stop mechanism. Such a design reduces manufacturing costs. The toy also may perform more realistically by reacting to a sensed input from a user by moving towards or away from the sensed input. Lastly, because the toy is in the form of a cat or domestic animal, the combined motion of the tail assembly and the back assembly imparts further realism to the toy.

Other features will be apparent from the description, the drawings, and the claims.

DESCRIPTION OF DRAWINGS

Like reference symbols in the various drawings indicate like elements.

DETAILED DESCRIPTION

Figure 1:
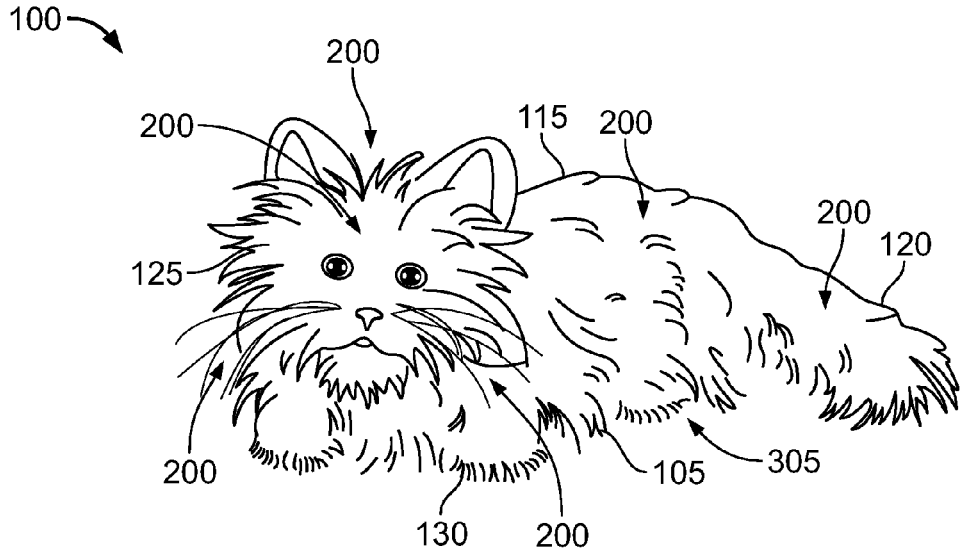
FIG. 1 is a perspective view of a toy.

Referring to FIG. 1, a toy 100 has a body 105 and movable regions 115, 120, and 125 connected to the body 105. The body 105 of the toy 100 houses components that control operation of the toy 100. The movable regions may be actuated during operation of the toy 100 to impart realism to the toy 100.

Figure 2:
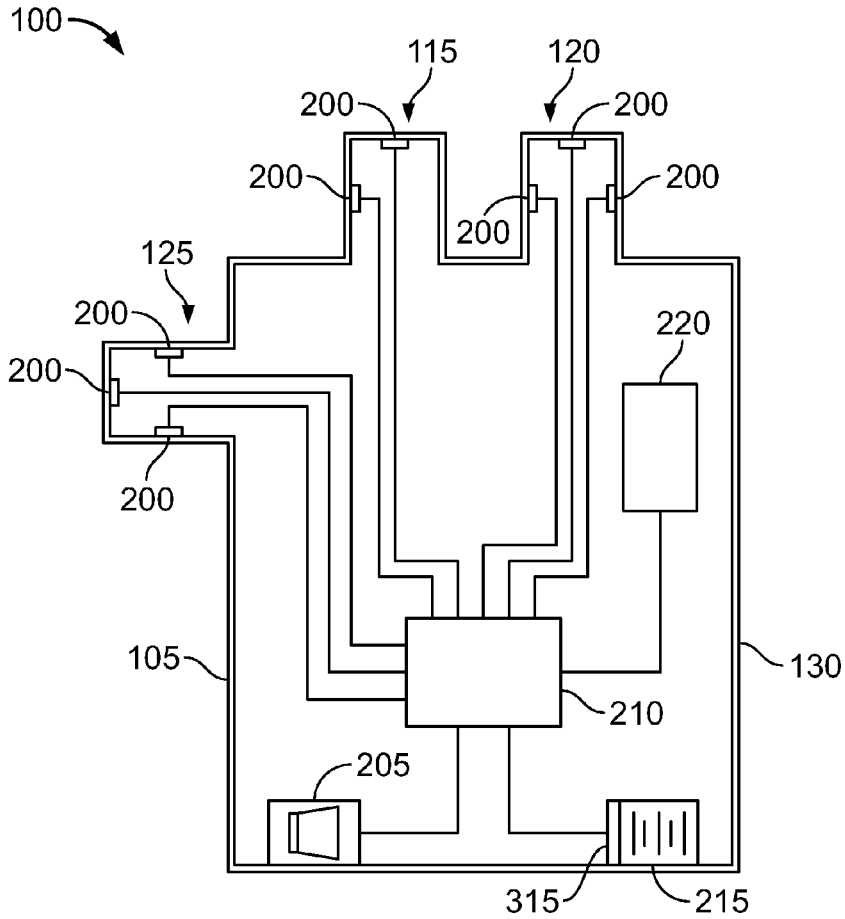
FIG. 2 is a block diagram showing electrical connections of the toy of FIG. 1.

Referring also to FIG. 2, the movable regions 110 include a back region 115, a tail region 120, and a head region 125. The body 105 and the movable regions 110 may be made of any suitable combination of materials. For example, the body 105 and movable regions 110 may include one or more external soft layers, such as pile 130, that encompass an internal assembly of interconnected rigid parts made of plastic and/or metal alloys. As shown, the toy 100 is in the shape of a cat.

Figure 3A:
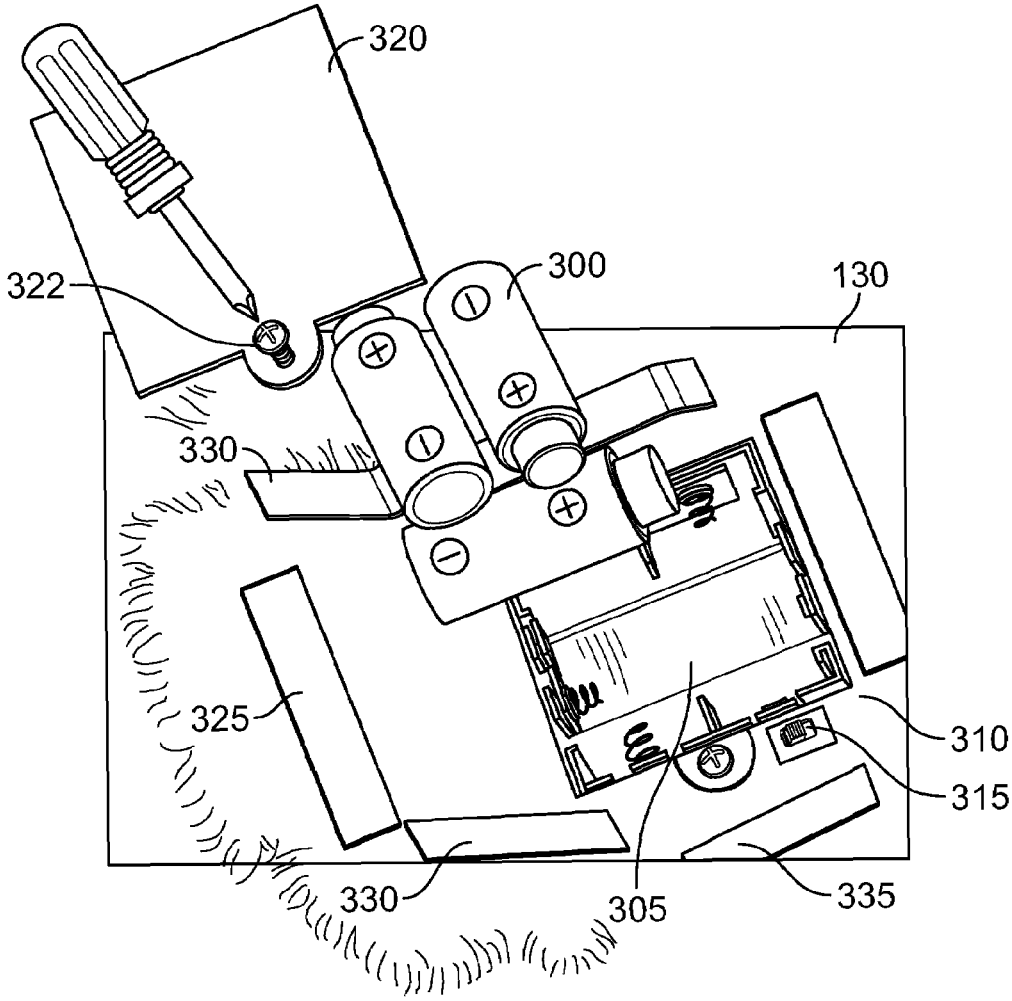
FIGS. 3A-3C are perspective views of a side of the toy of FIG. 1.
Figure 3B:
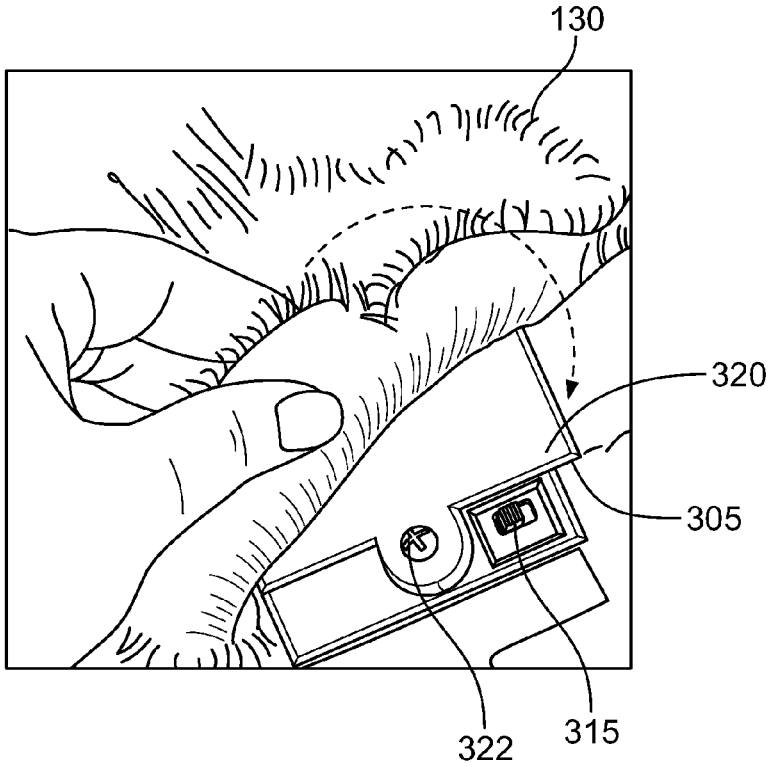
Figure 3C:
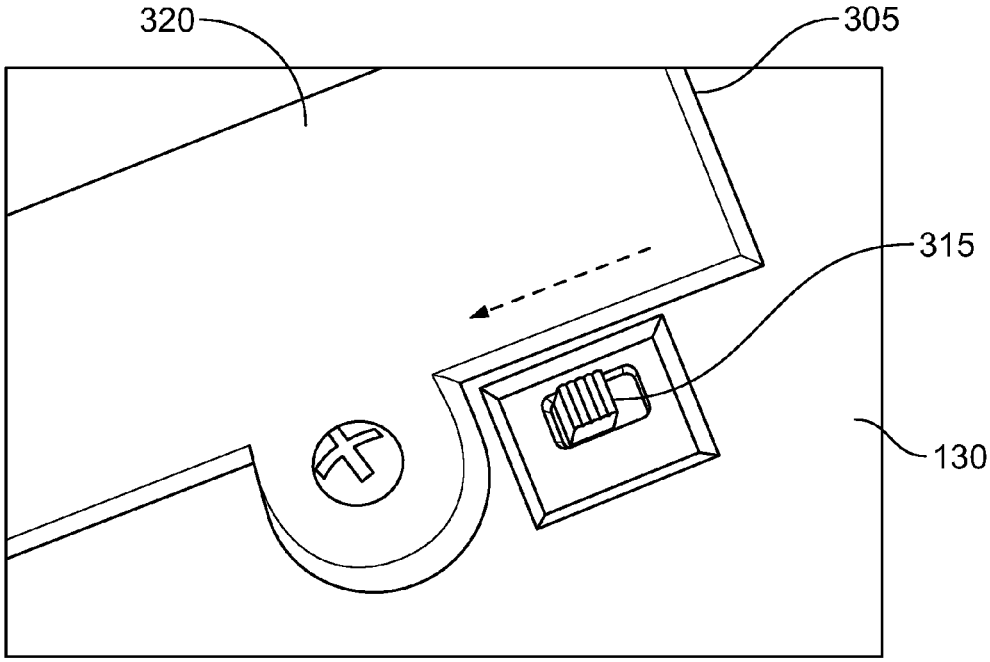

To further enhance realism, the movable regions of the toy 100 include input devices in the form of sensors 200 and the body 105 includes an output device in the form of an audio device 205 connected to a controller 210 within the body 105. The controller 210 receives power from a power source 215. For example, referring also to FIGS. 3A-3C, the power source 215 may be provided by batteries 300 that are placed within a compartment 305 on a lower side 310 of the body 105. The batteries 300 may be turned off and on by a switch 315 accessible on the compartment 305. The battery compartment 305 includes a rigid plastic cover 320 that is secured in place by a screw 322. A plush cover 325 is secured over the cover 320 by hook and loop fastening strips 330 and 335.

The controller 210 is connected to a motor 220 housed within the body 105 and coupled through various coupling devices (detailed below) to the movable regions to effect movement of the movable regions. The controller 210 includes, among other features, a microprocessor for operating the electronic components within the toy 100 and for receiving input from the sensors 200 through electrical connections such as wires. The controller 210 also includes memory, such as, for example, flash memory, RAM, ROM, or a sequential logic gate.

The sensors 200 are touch-sensitive devices. For example, a sensor 200 may be made of a conductive material and be a capacitively-coupled device such that when a user touches the toy 100 at the location of the capacitive sensor 200, a measured capacitance associated with the sensor 200 changes and the change is sensed. As another example, a sensor 200 may be made of a conductive material and be an inductively-coupled device. In this case, when a user touches the toy 100 at the location of the inductive sensor 200, a measured inductance associated with the inductive sensor 200 changes and the change is sensed.

Figure 4:
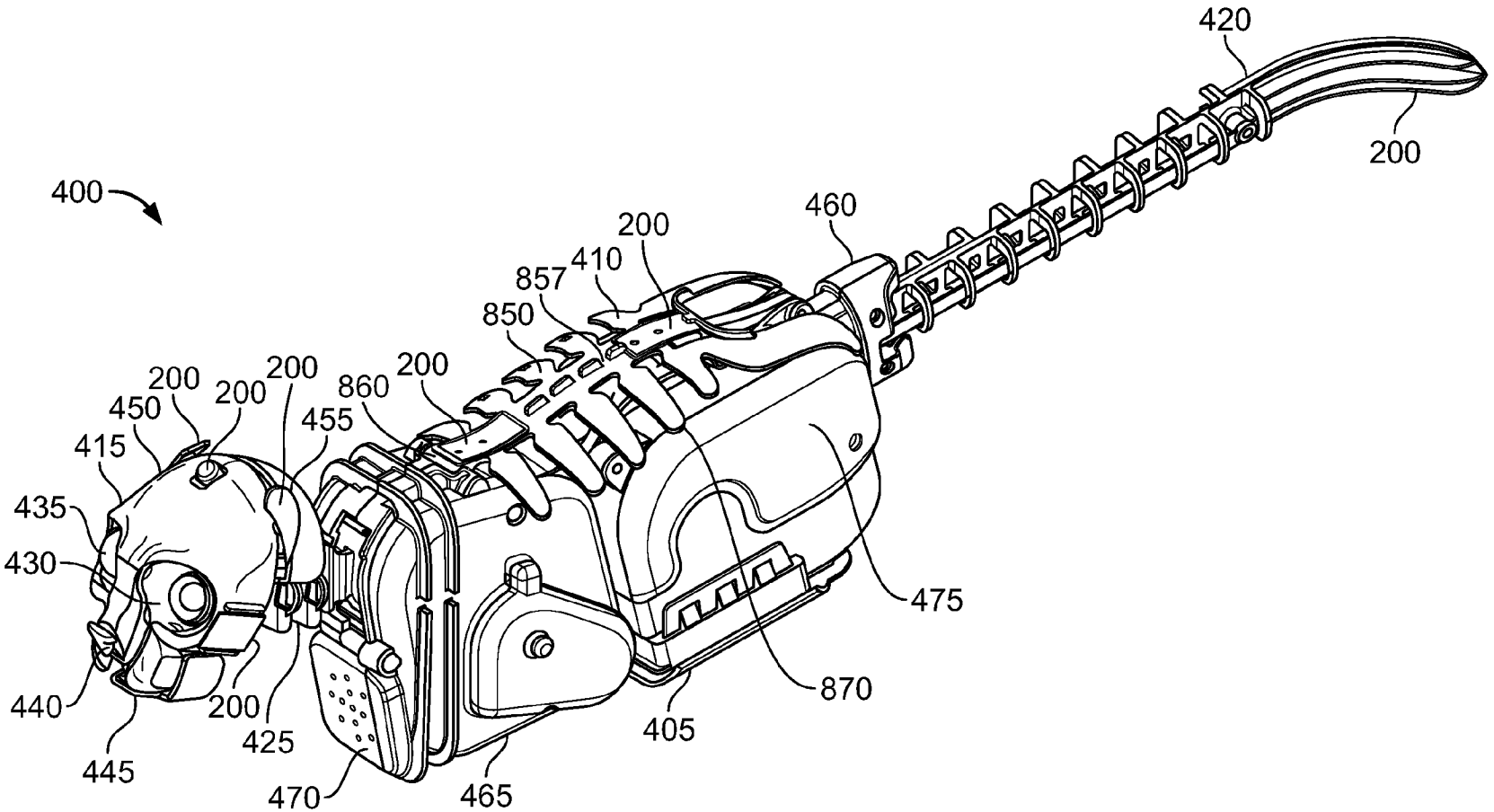
FIG. 4 is a top perspective view of an internal assembly of the toy of FIG. 1.
Figure 5:
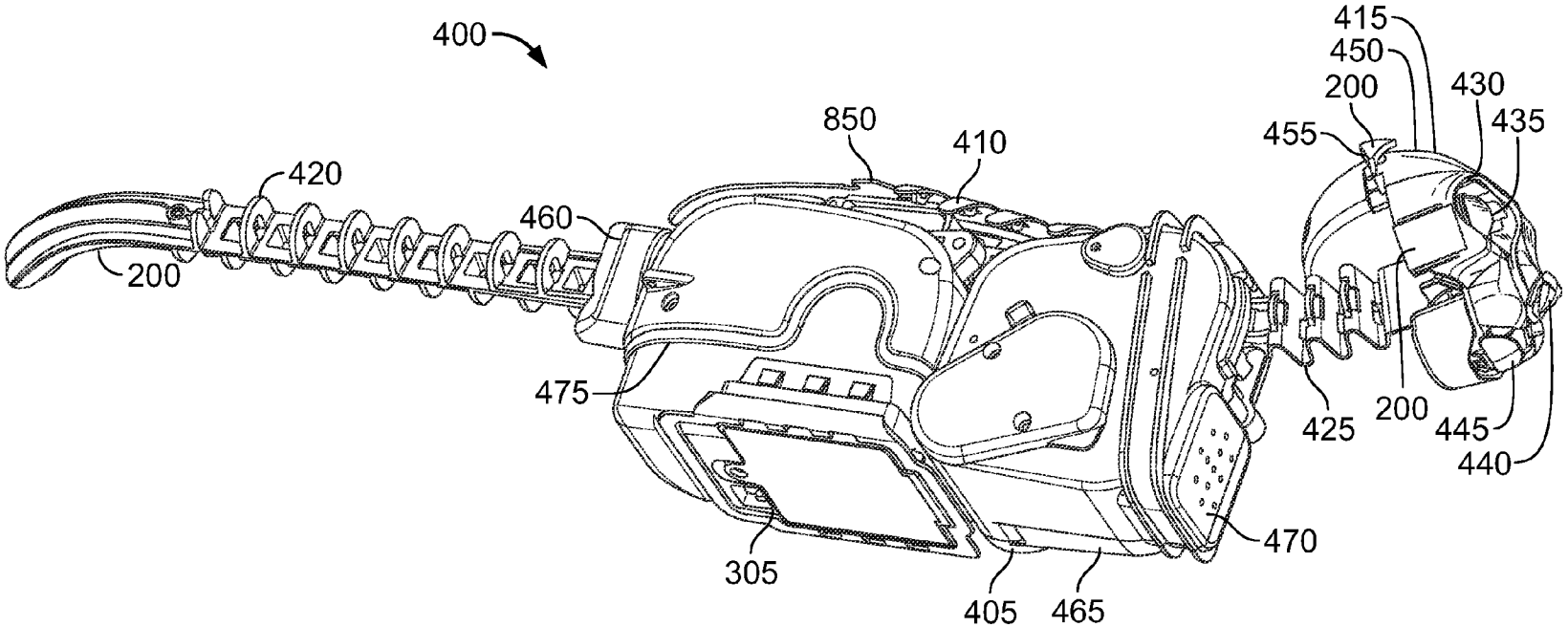
FIG. 5 is a bottom perspective view of the internal assembly of the toy of FIG. 1.
Figure 6:
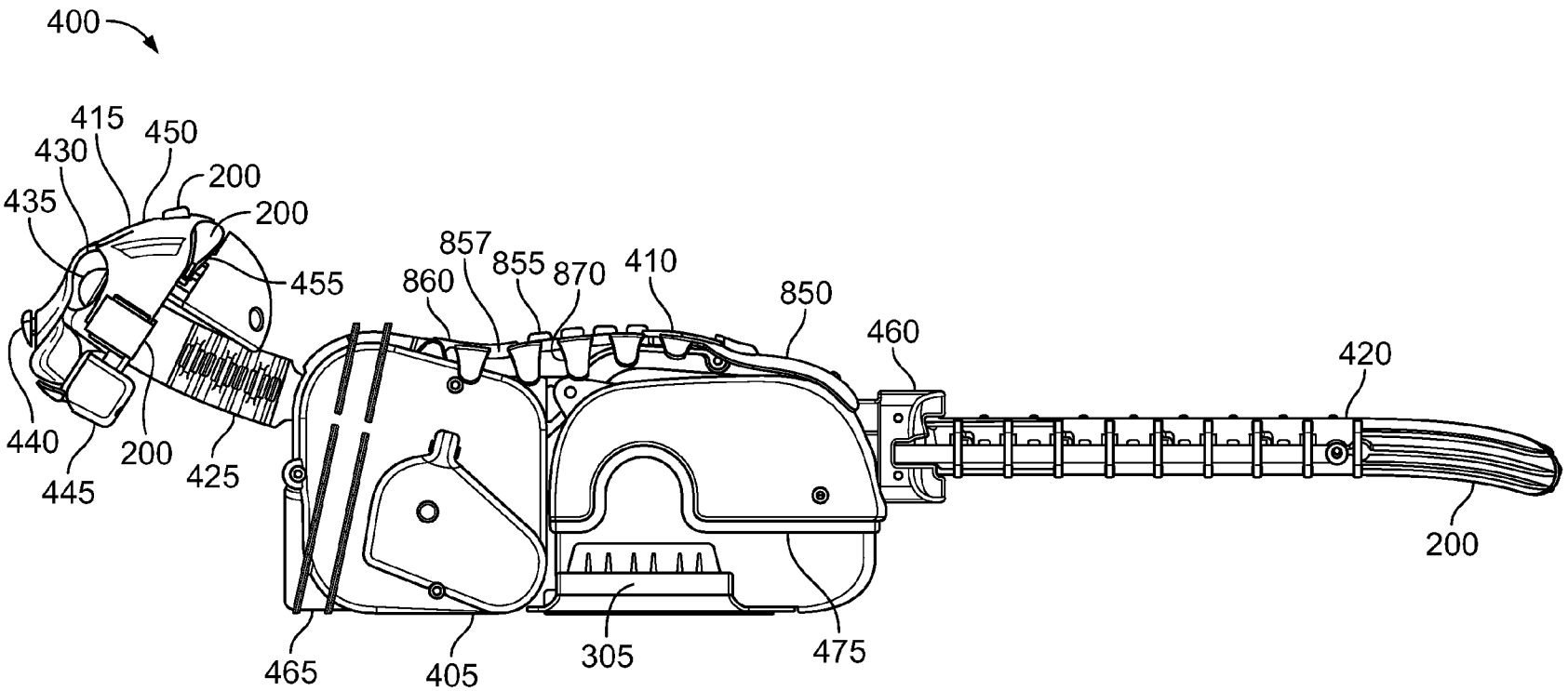
FIG. 6 is a plan view of the internal assembly of the toy of FIG. 1.

Referring also to FIGS. 4-12, and with particular reference to FIG. 4, the internal assembly 400 of the toy 100 includes a body assembly 405 that houses the electronic components, such as the controller 210, the motor 220, and the batteries 300; a back assembly 410 coupled to the body assembly 405; a head assembly 415 connected to the body assembly 405; and a tail assembly 420 connected to the body assembly 405.

The head assembly 415 is attached to the body assembly 405 through a flexible and movable neck assembly 425. Additionally, the head assembly 415 includes various features, such as eye sockets 430, eyes 435, a nose pad 440, a jaw 445, a skull 450, and ears 455 to impart a realistic appearance to the toy 100. The design and coupling of the neck assembly 425 is such that the neck assembly 425 is able to rotate up and down and to simultaneously twist or bend back and forth like a head of a cat.

The tail assembly 420 is attached to the body assembly 405 through a movable tail base 460. The design and coupling of the tail assembly 420 is such that the tail assembly 420 is able to rotate up and down and to simultaneously curl in an out in much the same way as a cat's tail. In one implementation, the neck assembly 425 and/or the tail assembly 420 are designed like the movable device described in U.S. application Ser. No. 10/073,122 (the '122 application), filed Feb. 12, 2002, which is incorporated herein by reference.

The body assembly 405 is formed with a first protective cover 465 having one or more openings 470 aligned with the audio device 205 to permit sounds to emanate from within the first protective cover 465. The first protective cover 465 is made of two pieces that interlock using any suitable locking mechanisms, such as screws and mating tapped holes or snap fit mechanisms. The body assembly 405 is formed with a second protective cover 475 made of two interlocking pieces. The body assembly 405 houses the compartment 305 and the movable tail base 460.

Figure 7:
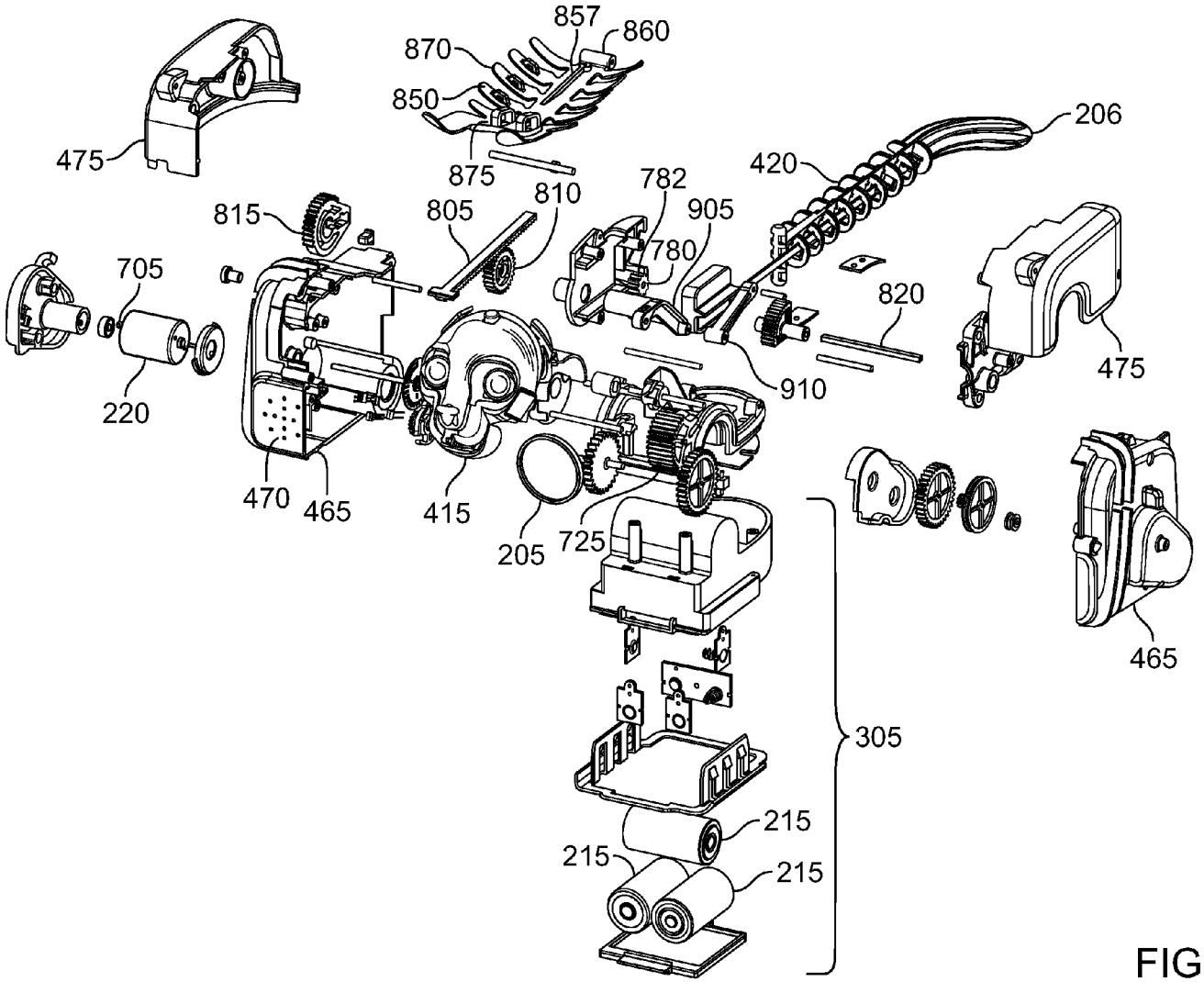
FIGS. 7 and 8 are exploded perspective views of the internal assembly of the toy of FIG. 1.
Figure 8:
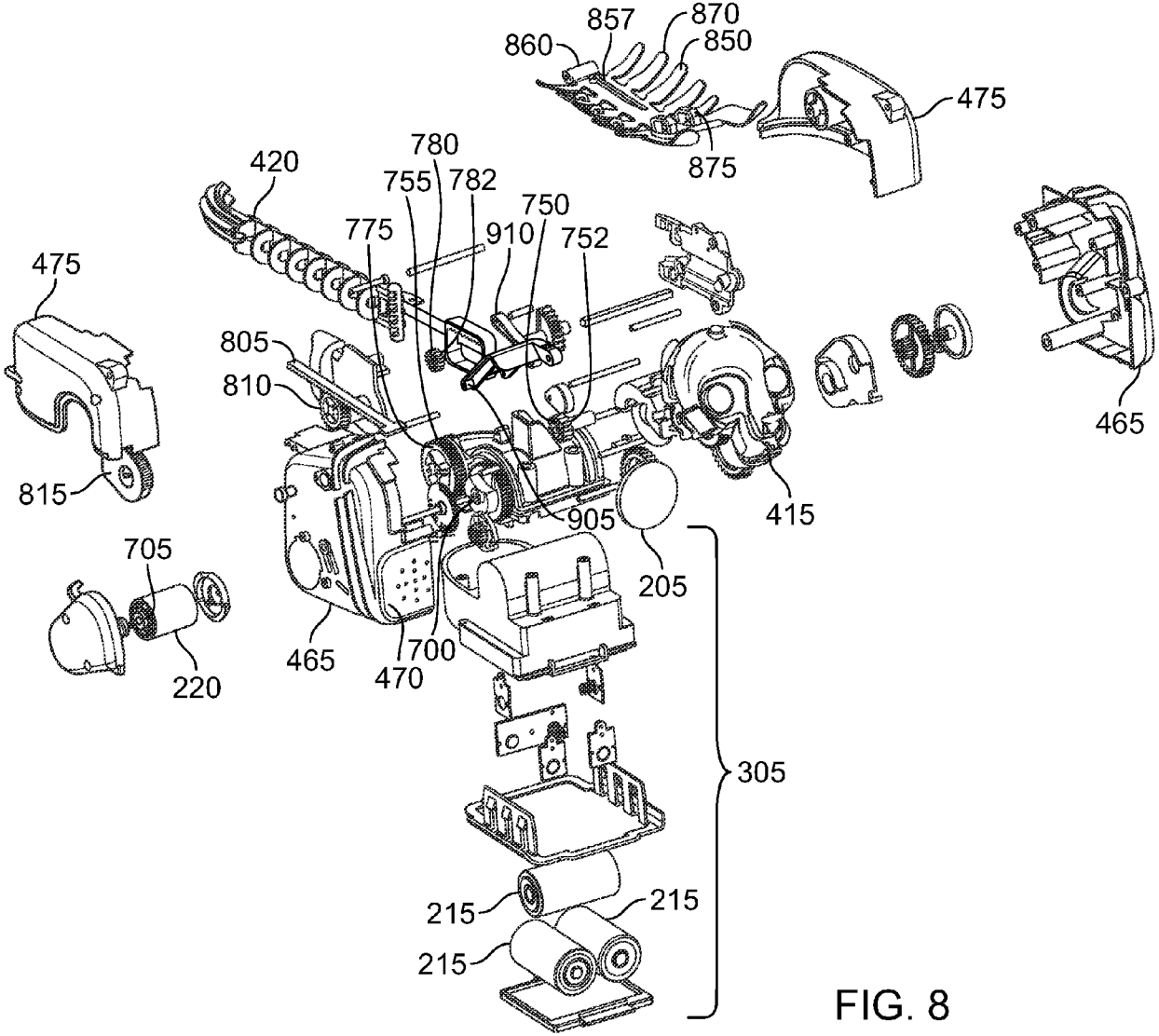
Figure 9:
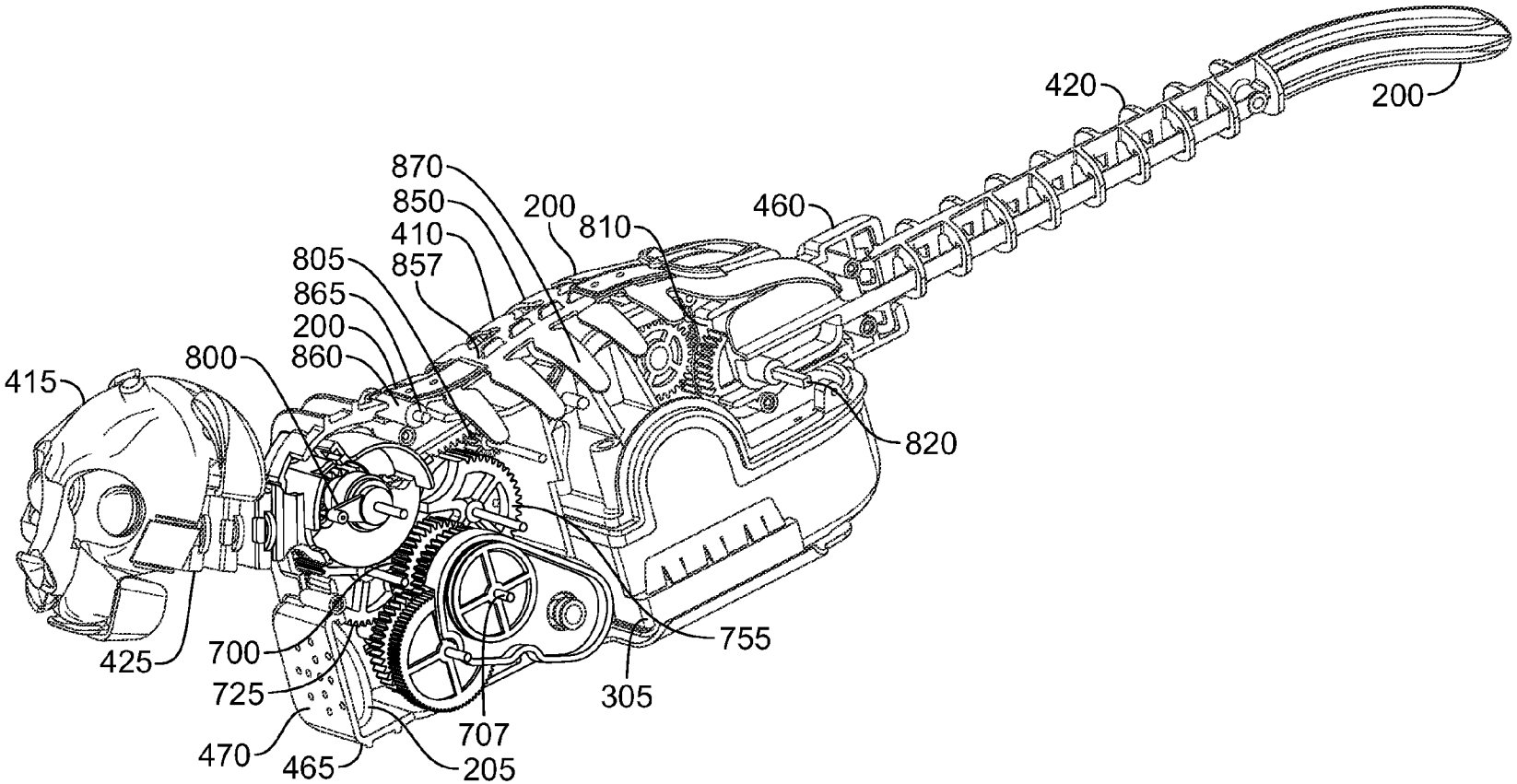
FIG. 9 is a top perspective view of the internal assembly of the toy of FIG. 1 in which components have been removed.
Figure 10:
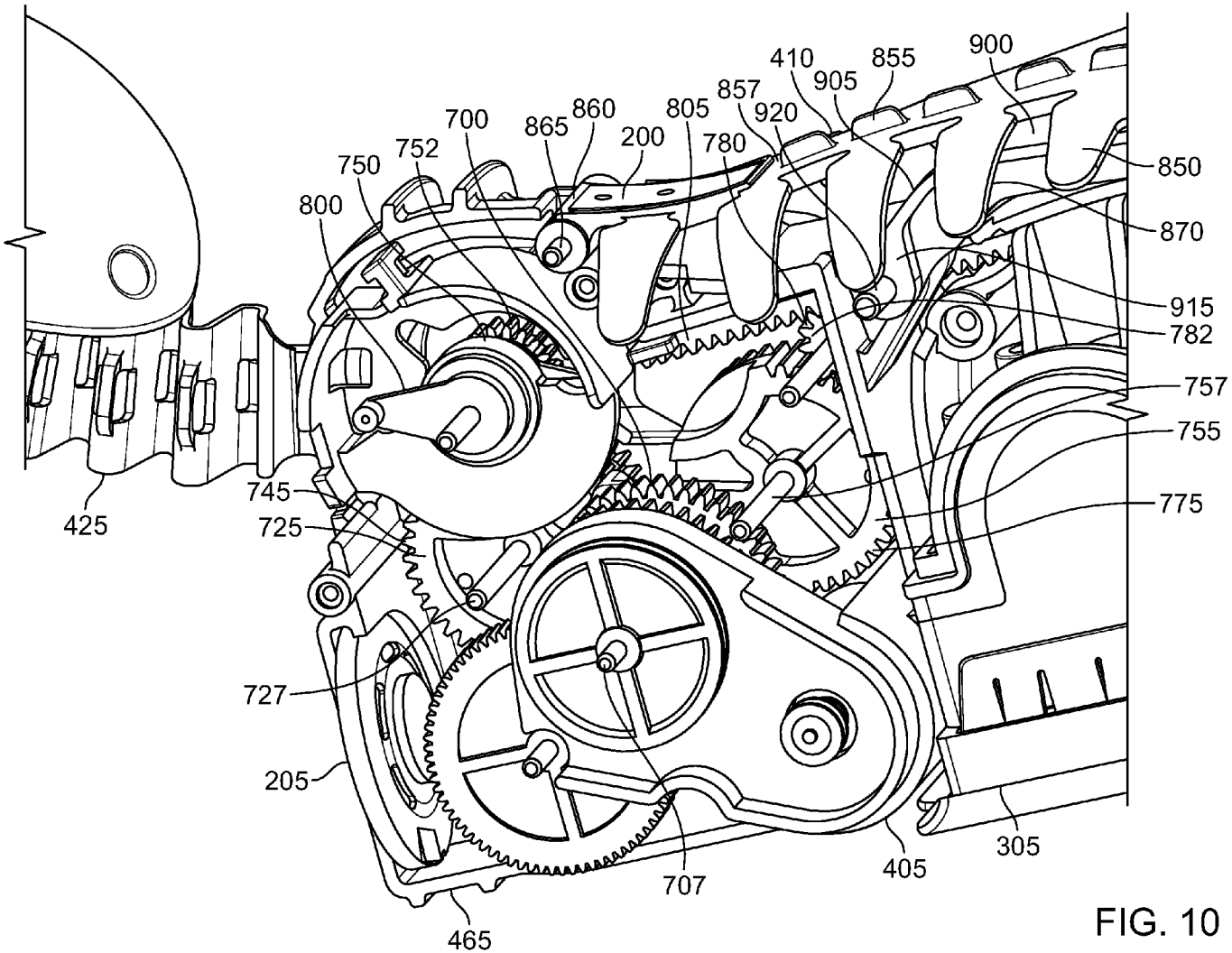
FIGS. 10-12 are enlarged perspective views of the internal assembly of the toy of FIG. 1 in which components have been removed.
Figure 11:
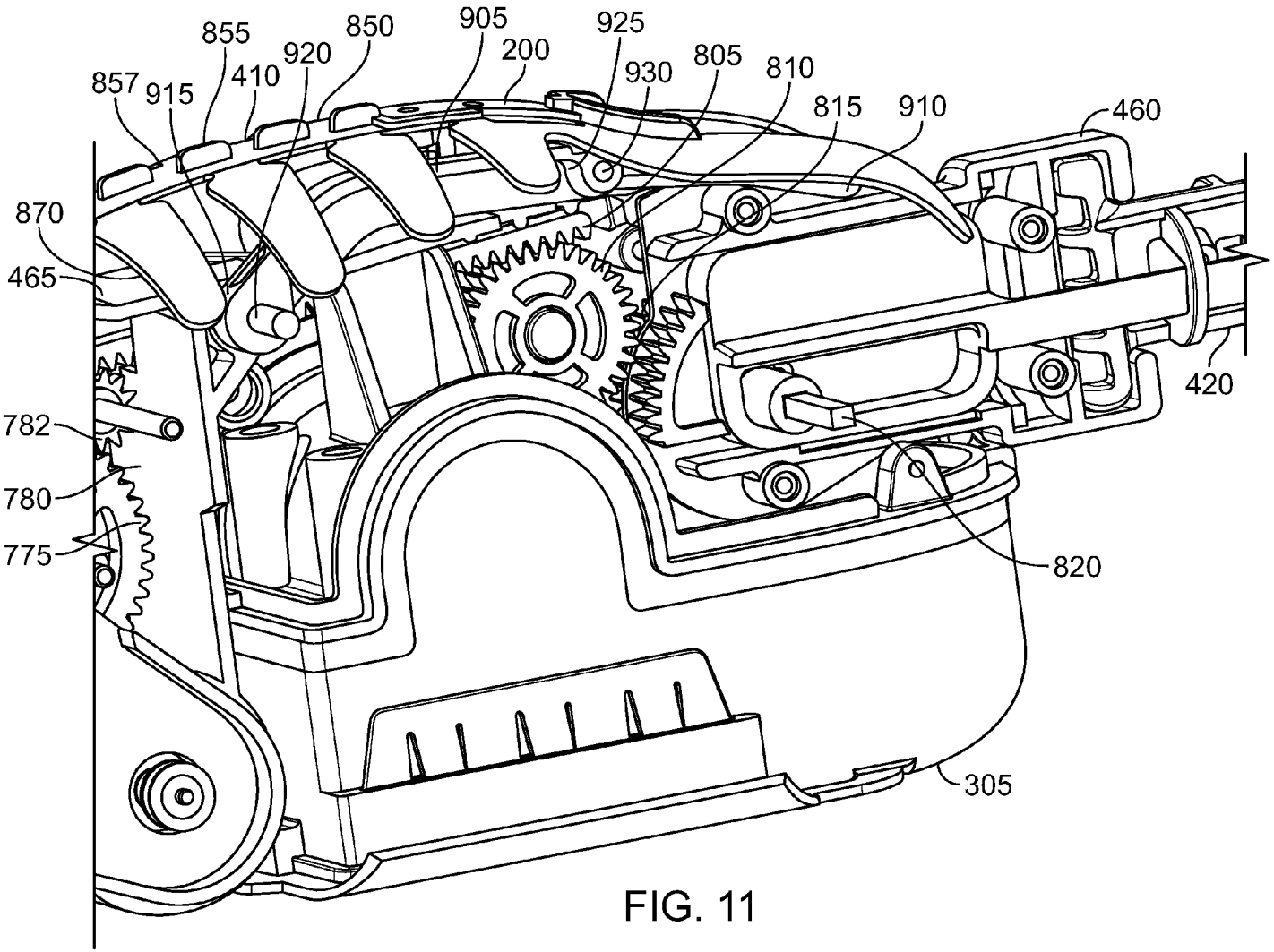

With particular reference to FIGS. 7 and 9, various electrical and mechanical components are housed within the first protective cover 465 of the body assembly 405. Thus, the motor 220 and the audio device 205 are housed within the first protective cover 465. Additionally, the first protective cover 465 houses a first set of gears and cams that couple with a second set of gears and cams housed within a second protective cover 475 for moving the back assembly 410, the head assembly 415, and the tail assembly 420. As also shown in FIGS. 9 and 10, the first set of gears and cams includes a drive wheel 700 coupled through a main drive 707 to other gears and cams and to a motor drive 705 of the motor 220.

Figure 13:
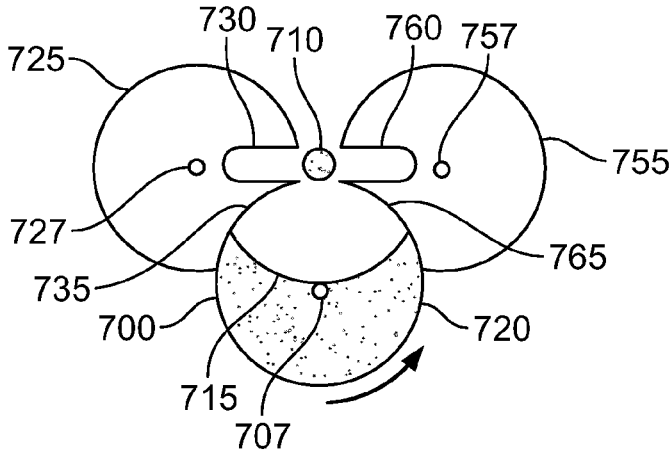
FIGS. 13-15 are plan views of an apparatus for driving tail and back regions in the internal assembly of the toy of FIG. 1.
Figure 14:
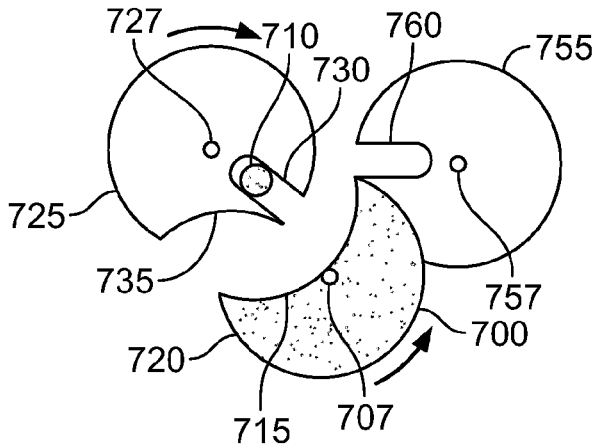
Figure 15:
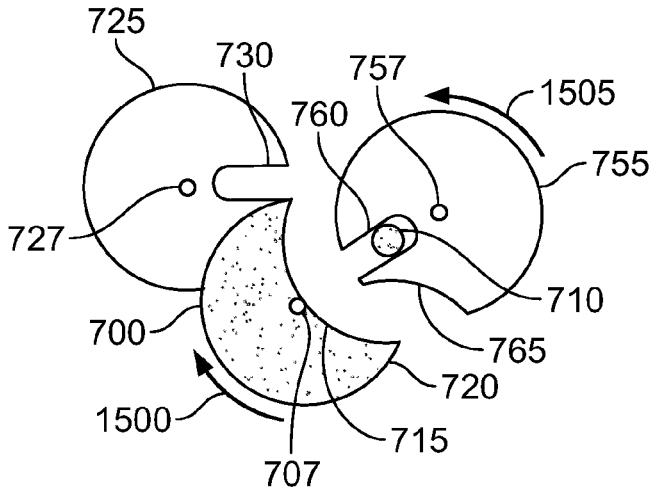

Referring also to FIGS. 13-15, the drive wheel 700 includes a drive pin 710, a convex portion 715, and a concave portion 720. The drive wheel 700 is coupled to a first device 725 that rotates about a first drive 727 and a second device 755 that rotates about a second drive 757.

The first device 725 includes a first slot 730 sized to receive the drive pin 710, a first concave portion 735 sized to match the convex portion 715 of the drive wheel 700, and a first mechanism 740 coupled to the head assembly 415 through the neck assembly 425. The first mechanism 740 is a gear having teeth 745 that match teeth 750 of a gear 752 coupled to the neck assembly 425.

The second device 755 includes a second slot 760 sized to receive the drive pin 710, a second concave portion 765 sized to match the convex portion 715 of the drive wheel 700, and a second mechanism 770 coupled to the tail assembly 420 through the movable tail base 460. The second mechanism 770 is a gear having teeth 775 that match teeth 780 of a gear 782 coupled to the movable tail base 460.

The first device 725, the second device 755, and the drive wheel 700 are positioned relative to each other such that, if the drive pin 710 engages the first slot 730, the convex portion 715 of the drive wheel 700 disengages the first concave portion 735 and engages the second concave portion 765 to lock the second device 755. If the drive pin 710 engages the second slot 760, then the convex portion 715 of the drive wheel 700 disengages the second concave portion 765 and engages the first concave portion 735 to lock the first device 725. This combined engagement/disengagement imparts a realistic motion to the toy 100. In particular, when the drive pin 710 engages the first slot 730, the head assembly 415, through the motion of the neck assembly 425 coupled to the first device 725, moves up and down and side to side. Simultaneously with the motion of the head assembly 415, the tail assembly 420, which is coupled to the second device 755, is locked into position. On the other hand, when the drive pin 710 engages the second slot 760, the tail assembly 420, through the motion of the movable tail base 460, which is coupled to the second device 755, moves up and down and side to side. Simultaneously with the motion of the tail assembly 420, the head assembly 415, which is coupled to the first device 725, is locked into position.

Figure 12:
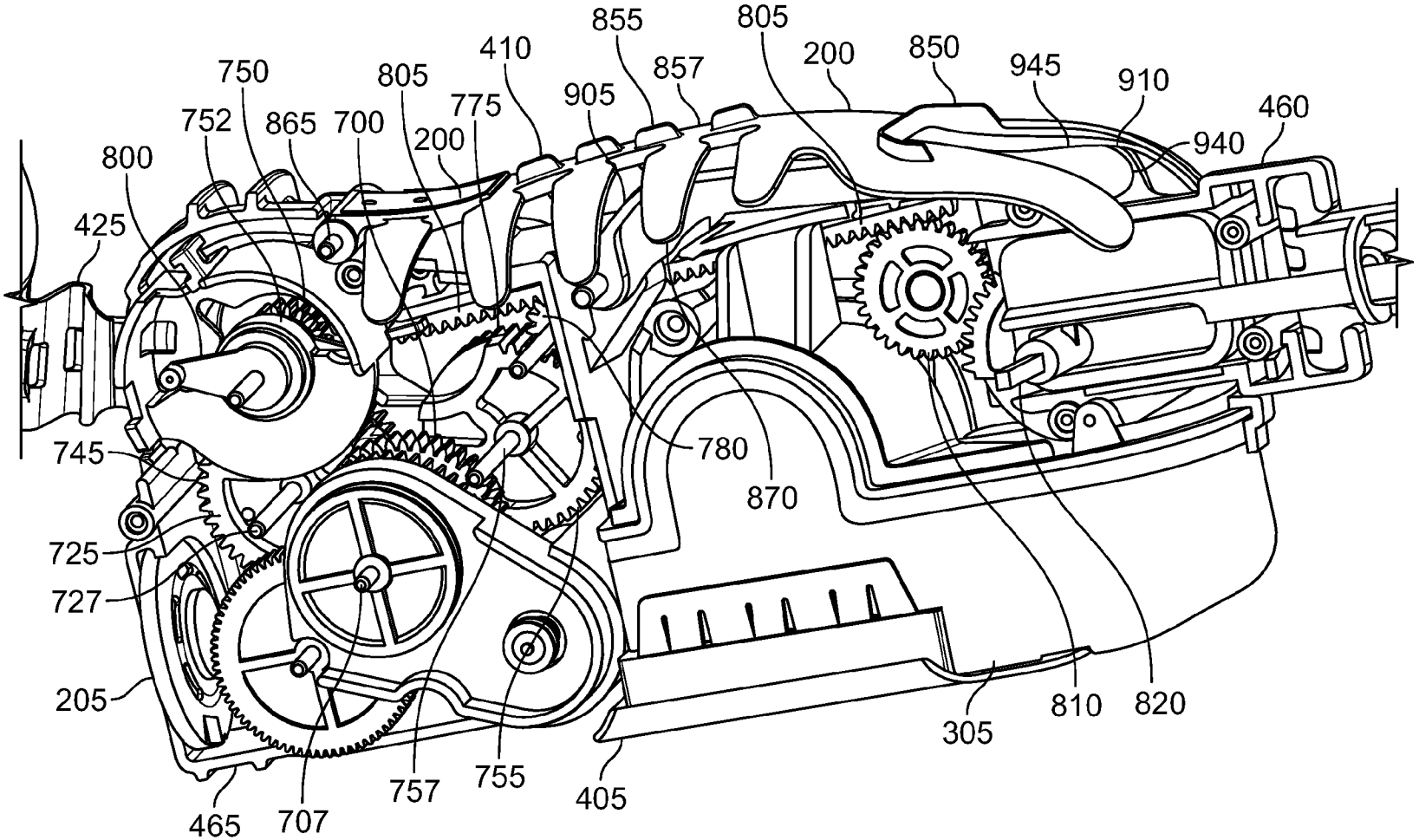

The gear 752 is coupled to the neck assembly 425 through a set of levers 800, one of which may be seen in FIGS. 9, 10, and 12. Detail of how the levers 800 interact with the neck assembly 425 may be found in the '122 application. The gear 782 is coupled to the movable tail base 460 through a rack 805 that is coupled to a gear 810, as seen in FIGS. 7-12. The gear 810 is coupled to a gear 815 (shown in FIGS. 7 and 8) attached to a tail drive 820 of the movable tail base 460.

As best shown in FIGS. 4, 6, 7, 9, and 12, the back assembly 410 includes a flexible portion 850 having ridges 855 formed along a center elongated portion 857 that extends along an elongated axis and between sensors 200 of the back assembly 410. The flexible portion 850 includes an end 860 that is fixed to the first protective cover 465 of the body assembly 405 while being able to rotate about a back pivot 865. The flexible portion 850 also includes ribs 870 extending along the length of the flexible portion 850 to simulate ribs of a cat and to facilitate flexibility of the flexible portion 850. The flexible portion 850 includes a hook 875 on a side of the flexible portion 850 adjacent the second protective cover 475.

Figure 16:
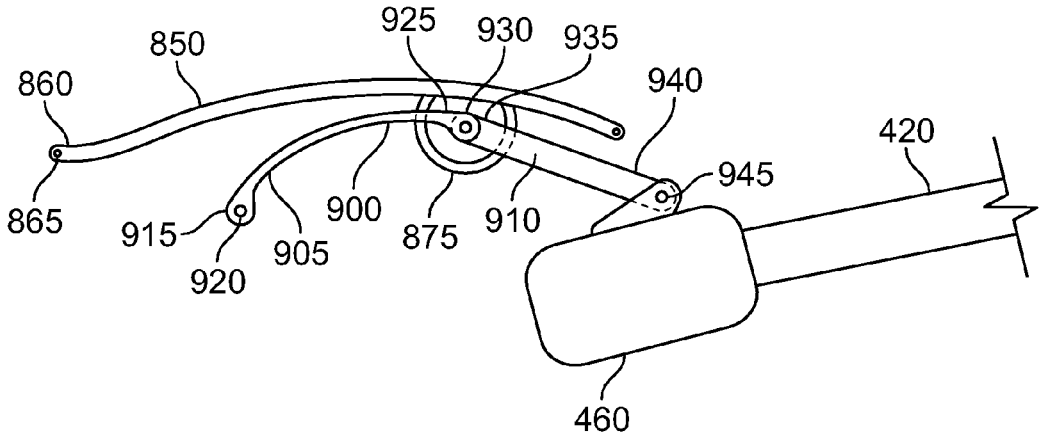
FIGS. 16 and 17 are plan views of a coupling device within the internal assembly of the toy of FIG. 1.
Figure 17:
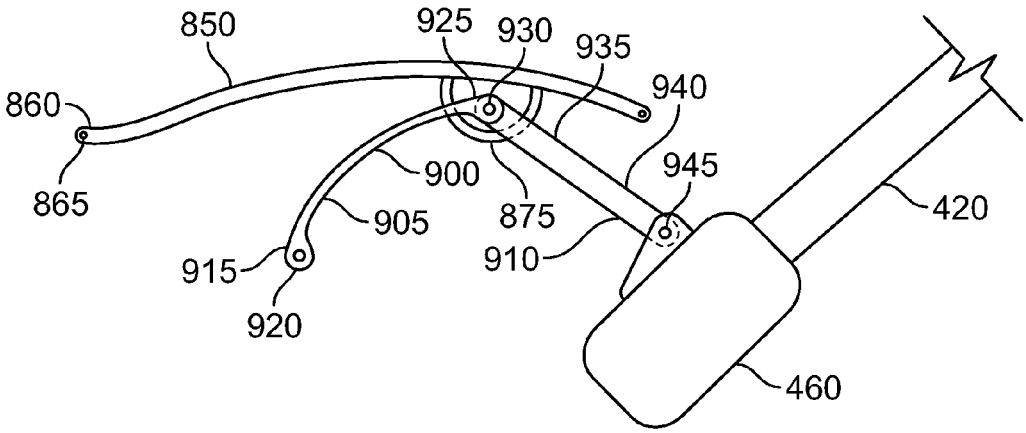

Referring also to FIGS. 16 and 17, the body assembly 405, the back assembly 410, and the tail assembly 420 are coupled together through a coupling device 900. The coupling device 900 includes a body-to-back piece 905 and a back-to-tail piece 910. The body-to-back piece 905 includes a first end 915 that is fixed to the first protective cover 465 while being able to rotate about a body pivot 920. The body-to-back piece 905 also includes a second end 925 that is constrained to move within the hook 875 about a back pivot 930. The back-to-tail piece 910 includes a first end 935 that also is constrained to move within the hook 875 about the back pivot 930. The back-to-tail piece 910 includes a second end 940 that is fixed to the movable tail base 460 while being able to rotate about a tail pivot 945 of the tail base 460.

The toy 100 operates through the controller 210 to achieve several different motions, each of which is detailed below.

Figure 18:
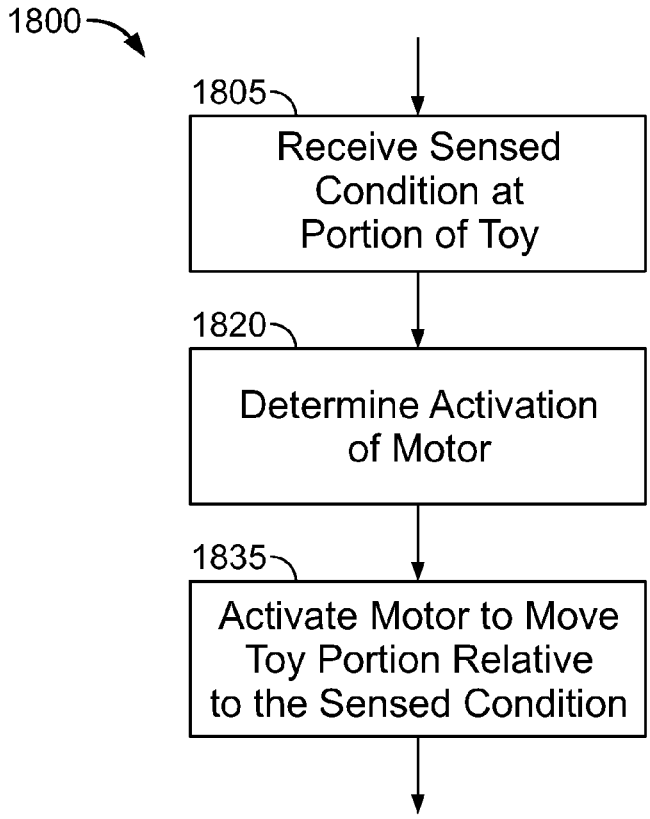
FIGS. 18 and 26 are flow charts of procedures performed by a controller within the toy of FIG. 1.

Referring to FIG. 18, the controller 210 performs a procedure 1800 for controlling the toy 100. Initially, the controller 210 receives a sensed condition from a sensor 200 in one of the movable regions 110 (step 1805). For example, with reference also to FIG. 19, the controller 210 may receive a sensed condition from the sensor 200 within the skull 450 of the head assembly 415 in response to pressure on the head 125.

Figure 20:
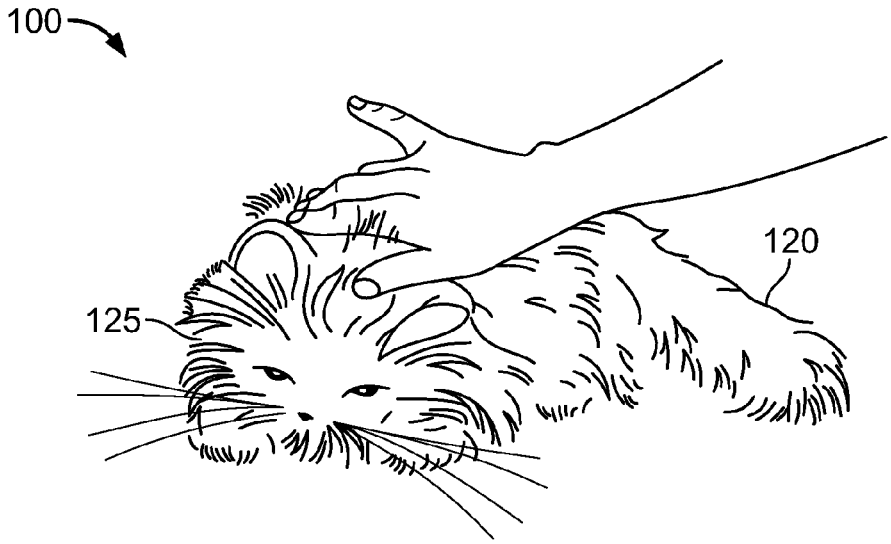
Figure 21:
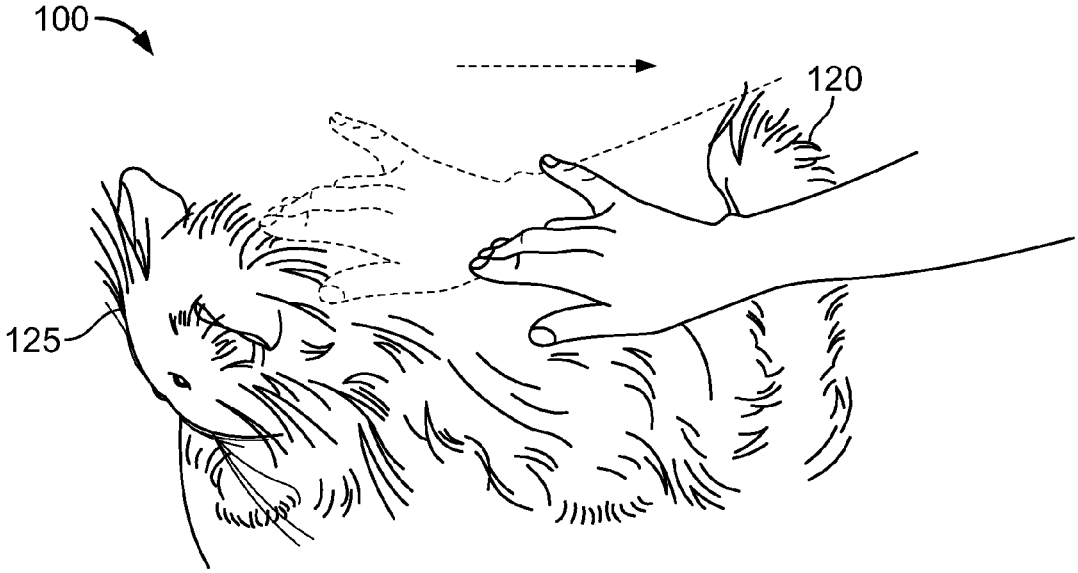
Figure 22:
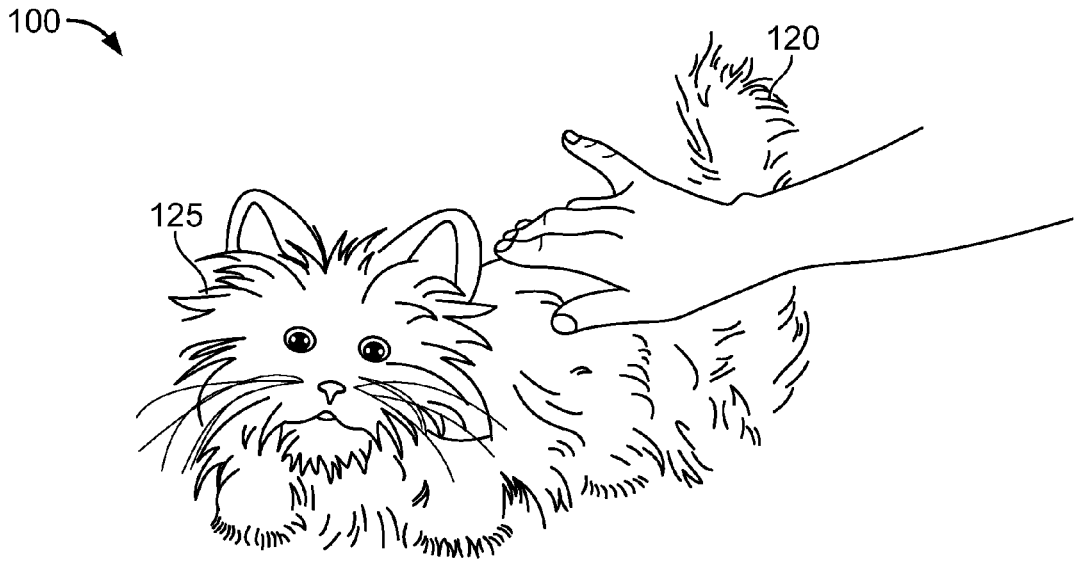

With reference also to FIG. 20, the controller 210 may receive a sensed condition from the sensor 200 near the end 860 of the flexible portion 850 in response to pressure on the shoulder of the toy 100. Similarly, with reference also to FIG. 21, the controller 210 may receive a sensed condition from the sensor 200 near the end 860 and, simultaneously or consecutively in time, a sensed condition from the sensor 200 near the hook 875 of the flexible portion 850 in response to a petting motion. With reference also to FIG. 22, the controller 210 may receive a sensed condition from the sensor 200 near the hook 875 of the flexible portion 850 in response to pressure on the back of the toy 100.

Figure 23:
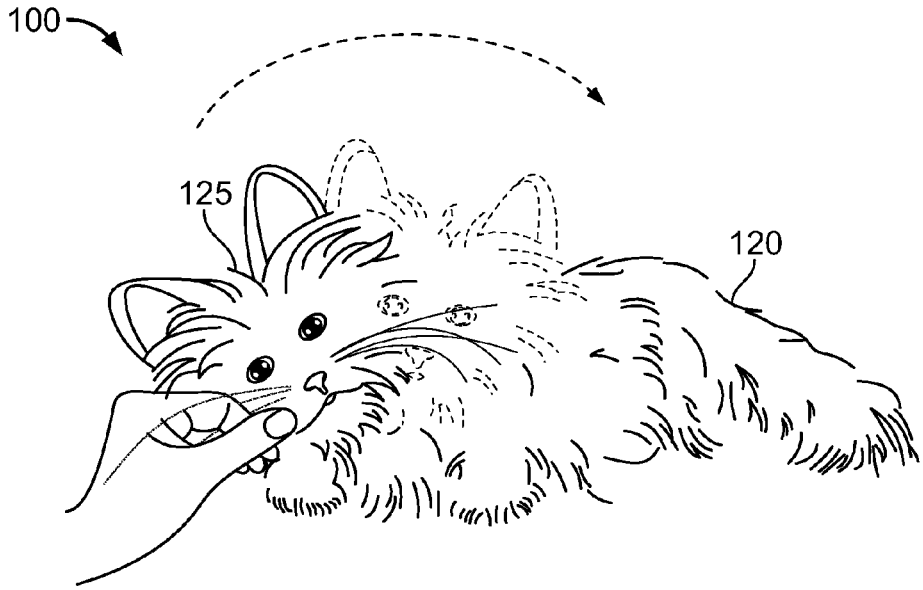
Figure 24:
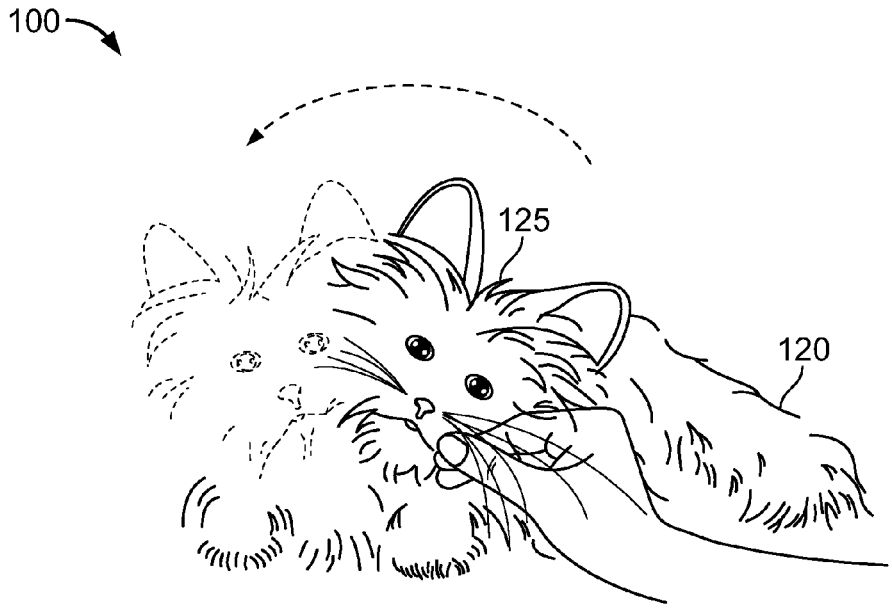
Figure 25:
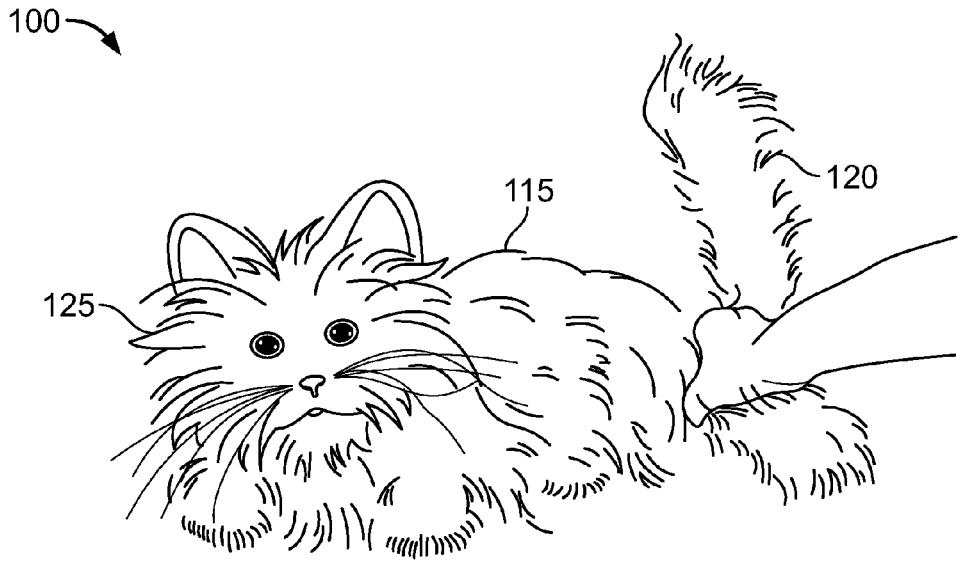

With reference also to FIGS. 23 and 24, the controller 210 may receive a sensed condition from the sensor 200 at a right side of the skull 450 of the head assembly 415 (FIG. 23) or from the sensor 200 at a left side of the skull 450 of the head assembly 415 (FIG. 24) in response to pressure on the corresponding sides of the toy's face. As a final example, and with reference also to FIG. 25, the controller 210 may receive a sensed condition (simulating a tail grabbing) from the sensor 200 within the tail assembly 420.

Upon receiving the sensed condition (step 1805), the controller 210 determines which direction or combination of directions to drive or activate the motor 220 (step 1820) to affect an appropriate response from the toy 100. Next, the controller 210 activates the motor 220 based on this determination (step 1835). When activated, the motor 220 moves the movable region 110 relative to the location of the sensor 200 that received the condition. Thus, the motor 220 may move the movable region 110 towards or away from the location at which the condition was sensed relative to the movable region 110.

Figure 19:
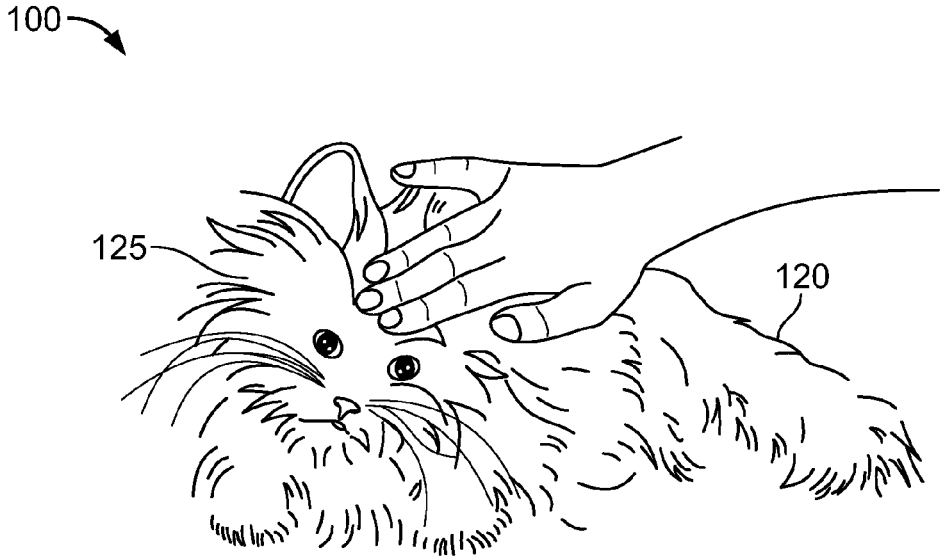
FIGS. 19-25 are perspective view of the toy of FIG. 1.

Thus, for example, if the controller 210 senses a condition from the sensor 200 within the skull 450 of the head assembly 415 (for example, pressing as shown in FIG. 19), the controller may activate the motor 220 to move the head assembly 415 downwards away from the sensed condition. As another example, if the controller 210 senses a condition from the sensor 200 near the hook 875 of the flexible portion 850, the motor 220 arches the flexible portion 850 (as shown in FIG. 17, in which the flexible portion 850 is arched relative to the flexible portion 850 shown in FIG. 16). As a further example, if the controller 210 senses a condition from the sensor 200 at the right side of the skull 450 (FIG. 23), the motor 220 moves the head assembly 415 towards the right whereas if the condition is sensed from the sensor at the left side of the skull 450 (FIG. 24), the motor 220 moves the head assembly 415 towards the left.

Each of these motions within a particular movable region 110 may be performed in combination with other motions within that particular movable region 110. Thus, as the motor moves the head assembly 415 towards the right in response to the sensed condition at the right side of the skull 450, the motor may move the head assembly 415 up or down.

Additionally or alternatively, the controller 210 may send a signal to the audio device 205 in response to any of the above sensed conditions. For example, upon sensing the petting condition (FIG. 21), the controller 210 may send a signal to the audio device 205 to cause the audio device 205 to emit a purring sound or a meow sound. As another example, upon sensing the tail grabbing (FIG. 25), the controller 210 may send a signal to the audio device 205 to cause the audio device 205 to emit a hissing sound.

Figure 26:
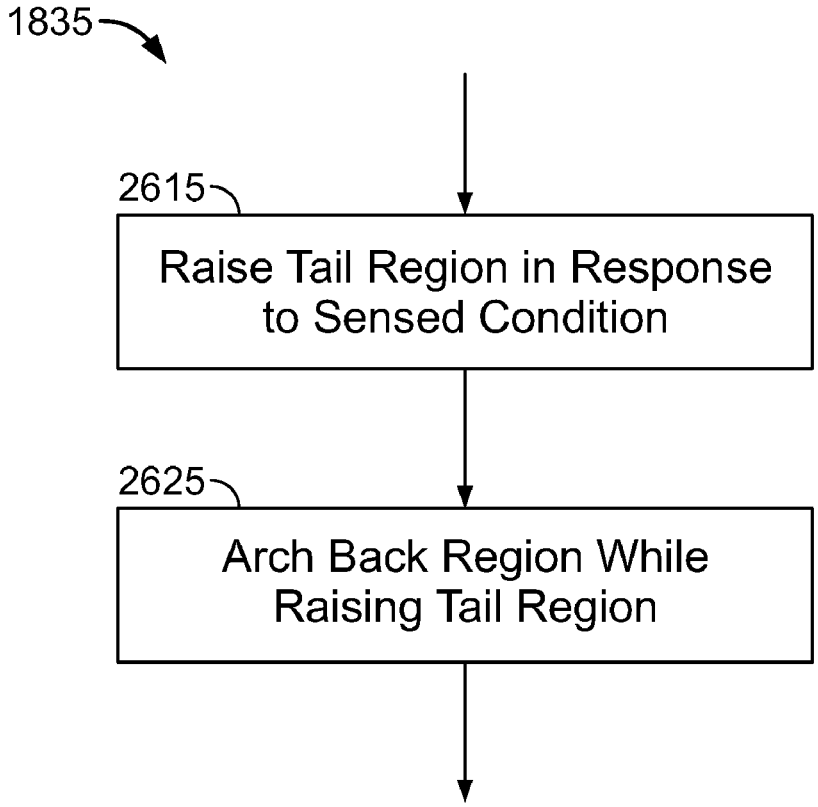

Referring to FIG. 26, and with reference also to FIGS. 15-17, the controller 210 performs a procedure 1835 for activating the motor to move the back assembly 410 and the tail assembly 420 upon sensing a particular condition. Initially, the controller 210 sends a signal to the motor 220 to cause the motor 220 to raise the tail assembly 420 (step 2615). The motor 220 raises the tail assembly 420 by rotating the drive wheel 700 in a clockwise direction (as shown by the arrow 1500 in FIG. 15), thus causing the drive pin 710 to engage the second slot 760 of the second device 755 to rotate the second device 755 in a counterclockwise direction (as represented by the arrow 1505 in FIG. 15). Once the second device 755 begins to rotate in the counterclockwise direction 1505, the gear 782 rotates in a clockwise direction and causes the rack 805 to move toward the tail assembly 420, which causes the gear 810 to rotate clockwise, thus raising the movable tail base 460 and the tail assembly 420 (as shown in FIG. 17).

Next, the controller 210 causes the back to arch simultaneously with the raising of the tail assembly 420 (step 2625). The controller 210 need not send out another electrical signal to the motor 220 to affect the arching motion. Rather, the raising of the tail assembly 420 causes the back assembly 410 to arch, as detailed below. As the motor 220 raises the movable tail base 460, the tail pivot 945 is raised. As the tail pivot 945 is raised, the back-to-tail piece 910, which is rotatably fixed to the tail pivot 945, is pushed towards the head assembly 415. Because the back-to-tail piece 910 cannot continue to move towards the head assembly 415 and is constrained by movement within the hook 875 by the body-to-back piece 905 (which is rotatably fixed to the body pivot 920), the back-to-tail piece 910 and the body-to-back piece 905 push up towards the back assembly 410. This upward motion causes the flexible portion 850 to arch upward (as shown in FIG. 17).

Other implementations are within the scope of the following claims.

For example, the toy 100 may be of any design, such as, for example, a doll, a plush toy such as a stuffed animal, a dog or other animal, or a robot. The movable regions 110 of the toy 100 may include output devices or the body 105 may include input devices or more than one output device. The output device may be an optical device or an electro-mechanical device. The body 105 and/or the movable regions 10 may include a resilient material between the internal rigid parts and the external layers to further enhance realism of the toy 100.

One or more of the sensors 200 may be a pressure sensing device such as, for example, a pressure-activated switch in the form of a membrane switch. One or more of the sensors 200 may be a light-sensing device, such as, for example, an IR-sensing device or a photocell. Additionally or alternatively, one or more of the sensors 200 may be a sound-sensing device such as, for example, a microphone.

What is claimed is:

1. A toy simulating an animated being, the toy comprising:
- a torso simulating a torso of the animated being;
- a movable element coupled to the torso and simulating a movable body component of the animated being;
- a sensor within the movable element, the sensor being configured to sense a condition and to produce a sensed condition signal in response to the sensed condition;
- an actuator within the torso and coupled to the movable element; and
- a controller within the torso, coupled to the sensor and the actuator, and configured to activate the actuator upon receipt of the sensed condition signal from the sensor to move the movable element in a direction towards the sensed condition to simulate life-like movement of the animated being.

2. The toy of claim 1 in which the sensor includes a touch-sensitive device.

3. The toy of claim 2 in which the touch-sensitive device includes a capacitively-coupled device.

4. The toy of claim 2 in which the touch-sensitive device includes an inductively-coupled device.

5. The toy of claim 1 in which the sensor includes a pressure-activated switch.

6. The toy of claim 1 in which the sensor includes a light-sensing device.

7. The toy of claim 1 in which the sensor includes a sound-sensing device.

8. The toy of claim 1 in which the movable element is a head assembly of the toy and the actuator is coupled to the head assembly to move the head assembly toward the sensed condition.

9. The toy of claim 8 in which the sensor includes a touch-sensitive device.

10. The toy of claim 8 in which the sensor is within the head assembly.

11. The toy of claim 1 in which the torso is in the form of an animal torso and the movable element is the head of the animal.

12. The toy of claim 1, in which the toy simulates a cat.

13. The toy of claim 12, in which the movable element is a back region of the cat, a tail region of the cat, or a head region of the cat.

14. The toy of claim 1, in which the toy simulates an animal.

15. The toy of claim 1 in which the toy includes at least one appendage.

16. The toy of claim 15 in which the at least one appendage is a leg.

17. A toy simulating an animated being, the toy comprising:
- a torso simulating a torso of an animated being;
- a movable element coupled to the torso and simulating a movable body component of the animated being;
- a sensor within the movable element, the sensor being configured to sense a condition and to produce a sensed condition signal in response to the sensed condition;
- an actuator within the torso and coupled to the movable element; and
- a controller within the torso, coupled to the sensor and the actuator, and configured to activate the actuator to move the movable element in a direction away from the sensed condition to simulate life-like movement of the animated being.

18. The toy of claim 17 in which the sensor includes a touch-sensitive device.

19. The toy of claim 18 in which the touch-sensitive device includes a capacitively-coupled device.

20. The toy of claim 18 in which the touch-sensitive device includes an inductively-coupled device.

21. The toy of claim 17 in which the sensor includes a pressure-activated switch.

22. The toy of claim 17 in which the sensor includes a light-sensing device.

23. The toy of claim 17 in which the sensor includes a sound-sensing device.

24. The toy of claim 17 in which the toy includes at least one appendage.

25. The toy of claim 24 in which the at least one appendage is a leg.

26. A method of actuating a toy that simulates an animated being, the method comprising:

receiving a sensed condition at a portion of the toy that is coupled to a torso of the toy that simulates a torso of the animated being;

producing a sensed condition signal in response to the sensed condition;

determining how to activate a motor within the torso of the toy based on the sensed condition signal and based on an appropriate response from the toy; and sending a signal to an actuator within the torso to cause the motor to move the portion of the toy relative to the torso of the toy in a direction towards the sensed condition based on the determination to simulate life-like movement of the animated being.

27. The method of claim 26 in which receiving the sensed condition includes receiving a change in capacitance at the toy portion.

28. The method of claim 26 in which receiving the sensed condition includes receiving a change in inductance at the toy portion.

29. The method of claim 26 in which receiving the sensed condition includes receiving a change in pressure at the toy portion.

30. The method of claim 26 in which receiving the sensed condition includes receiving a change in light intensity at the toy portion.

31. The method of claim 26 in which receiving the sensed condition includes receiving a change in audio intensity at the toy portion.

32. The method of claim 26 further comprising outputting an audio signal in response to the received condition.

33. The method of claim 32 in which outputting the audio signal is performed simultaneously with moving the toy portion.

34. A method of actuating a toy that simulates an animated being, the method comprising:

receiving a sensed condition at a portion of the toy that is coupled to a torso of the toy that simulates a torso of the animated being;

producing a sensed condition signal in response to the sensed condition;

determining how to activate a motor within the torso of the toy based on the sensed condition signal and based on an appropriate response from the toy; and sending a signal to an actuator within the torso to cause the motor to move the toy portion relative to the torso of the toy in a direction away from the sensed condition based on the determination to simulate life-like movement of the animated being.

35. The method of claim 26 in which receiving includes receiving the sensed condition at a head assembly of the toy.

36. The method of claim 35 in which moving the toy portion includes moving the head assembly towards the sensed condition.

37. The method of claim 26 wherein determining how to activate the motor includes determining, prior to moving the toy portion, whether to move the toy portion in a direction towards the sensed condition.

38. The method of claim 17 in which receiving the sensed condition includes receiving a change in capacitance at the toy portion.

39. The method of claim 34 in which receiving the sensed condition includes receiving a change in inductance at the toy portion.

40. The method of claim 34 in which receiving the sensed condition includes receiving a change in pressure at the toy portion.

41. The method of claim 34 in which receiving the sensed condition includes receiving a change in light intensity at the toy portion.

42. The method of claim 34 in which receiving the sensed condition includes receiving a change in audio intensity at the toy portion.

43. The method of claim 34 further comprising outputting an audio signal in response to the received condition.

44. The method of claim 43 in which outputting the audio signal is performed simultaneously with moving the toy portion.

45. A toy comprising:

a head region formed in a configuration of an animal character;

a touch-sensitive device in the head region, the touch-sensitive device configured to sense whether a user has touched the head region portion; and an actuator coupled to the head region and configured to move the head region including the touch-sensitive device in a direction relative to the sensed touch to simulate movement of the head region of the animal character in response to a sensed touch applied to the head region.

* * * * *